US005427018A

United States Patent [19]

Liebing

[11] Patent Number: 5,427,018

[45] Date of Patent: Jun. 27, 1995

[54] CENTRIFUGAL DISK FOR IMPACT MILLS, AIR CLASSIFIERS OR THE LIKE

[75] Inventor: Stefan Liebing, Braunschweig, Germany

[73] Assignee: Buehler GmbH, Braunschweig, Germany

[21] Appl. No.: 105,046

[22] Filed: Aug. 11, 1993

[30] Foreign Application Priority Data

Aug. 17, 1992 [DE] Germany ..... 42 27 178.9

[51] Int. Cl.[6] ..... B02B 3/00; B02B 7/02; B02C 9/02; B02C 9/04

[52] U.S. Cl. ..... 99/609; 99/519; 99/571; 99/612

[58] Field of Search ..... 99/518–520, 99/524, 574, 575, 600–602, 609, 612–614, 617, 618, 620–622, 571; 426/482, 483

[56] References Cited

U.S. PATENT DOCUMENTS 2,651,470 9/1953 Dodds et al. ..... 99/571
4,189,503 2/1980 Giguere ..... 99/618
4,393,762 7/1983 Jacobs .

*Primary Examiner*—Timothy F. Simone
*Attorney, Agent, or Firm*—Martin A. Farber

[57] ABSTRACT

A rotor disc for accelerating and projecting particles radially outwards off the disc toward an encircling impact element includes a rotatable disc base having radial channels for guiding particles radially outwards. The channels are formed of side walls fixed to the disc base with side faces on opposite sides of each channel. The corresponding side faces of each pair of sidewalls are arranged essentially parallel and have, in each pair of opposed faces, at least a first face which a radial chamfer having at least a first and a second chamfer face which are angled to form a groove disposed above the disc base for guiding the particles.

21 Claims, 2 Drawing Sheets

CENTRIFUGAL DISK FOR IMPACT MILLS, AIR CLASSIFIERS OR THE LIKE

FIELD AND BACKGROUND OF THE INVENTION

The invention relates to a centrifugal disk for impact mills, air classifiers or the like, in particular for seeds having shells, such as sunflower seeds, oats, psilium seeds and the like, having radial channels whose side walls are profiled.

Such centrifugal disks receive the material to be processed, generally via a feed means (pipe, hopper or the like), entering axially and are intended to centrifuge the material radially, it being possible for an impact ring to be arranged around the centrifugal disk. Frequently, such centrifugal disks have a smooth surface so that uniform transport of the grains is then not absolutely ensured. It has therefore also been proposed to provide the surface with furrows or channels through which the grains are carried.

However, it has been found that this measure too is not sufficient under all circumstances, since the granular material can also move in the axial direction and thus either escape from the effect of such a channel open at the top or acquire a different trajectory which deviates from the desired optimum trajectory.

U.S. Pat. No. 4,393,762 has also proposed trapping the grains with the aid of guide plates and introducing them into a channel bordered by parallel walls (i.e. at the bottom by the wall formed by the centrifugal disk itself and at the top by a parallel wall) and into a notch which is triangular in cross-section and which keeps the grain in a predetermined path, similarly to the missile of a catapult of antiquity. Such a means has proven very suitable in principle for certain granular materials to be treated, but there is a striking deterioration in the results in the case of other materials, even in comparison with conventional centrifugal disks of the above-mentioned type. The reason for this remained unclear for a long time and has also meant that this design has not become established in practice.

SUMMARY OF INVENTION

It is the object of the invention to design a centrifugal disk of the above-mentioned type in such a way that the grains are forced to follow a predetermined path, the treatment (air classification or milling in an impact mill) giving an optimum result.

In order to achieve this object, detailed investigations were first carried out to determine why the results give such different results in the case of a design of the last-mentioned type. Surprisingly, it has been found that it was the channel before the triangular notch which—although intended to feed the grains to the path formed by the notch—sometimes caused precisely the opposite. The reason is that these are natural products of very different sizes, so that grains having a larger dimension may remain behind in this channel bordered by parallel walls—generally at its entrance—and block the path of further grains flowing in, so that the guiding notch finally could not function at all. This discovery of the invention leads, in a second step, to the achievement that each radial channel has at least approximately parallel side walls, and the profiled structure of preferably one side wall of each channel forms at least one notch with notch surfaces running in the radial direction toward the circumference of the centrifugal disk, in particular diverging with respect to the axis of the channel. These inventive measures ensure, in an advantageous manner, that grains of any or different sizes and shapes are collected by the centrifugal disk, guided to their optimum trajectory and effectively accelerated, for example toward the impact surfaces of an impact mill.

The effect of the centrifugal disk is further improved for different grain sizes if, in a further embodiment of the invention, it is ensured that the notch surfaces of each notch have, preferably over the entire length of the notch, an essentially constant divergence in the direction of the radial axis of the channel.

In a preferred embodiment of the invention, the notch is formed by a profiling of the, or in the, side wall of each channel, said profile having a triangular cross-section. This profile has proved to be the one with the highest efficiency.

If, in a further embodiment of the invention, edges located at the notch opening, in particular other edges, on or in the side wall of the channel are blunted, rounded or beveled, any cutting effect is avoided and shelled whole seeds are obtained.

Grains which, owing to their size and/or shape, make it necessary to adapt the tools also have to be processed using machines such as impact mills, air classifiers and the like. For this purpose, in a preferred embodiment of the invention, the channels, preferably at least their side walls, are formed by sector-like and/or rib-like elements which are attached to the centrifugal disk, if necessary detachably, in particular via a rivet or screw connection, wedging or adhesive bonding.

The invention furthermore provides a feature of producing the sector-like and/or rib-like elements from a ceramic material which is preferably resistant to mechanical driving. This advantageous use of ceramic material has become possible because the edges of the profile of the side wall of the channels may be blunted, rounded or beveled. Where sharp edges are present, such materials tend to break.

According to a further preferred embodiment of the invention, sector-like and/or rib-like elements produced from aluminum oxide have proven particularly advantageous. Silicon nitride or silicon carbide would also be suitable but is expensive.

If the walls of the channels or the walls bordering the profile (notch) are made of ceramic material, for strength reasons it is fairly inexpedient for the entire centrifugal disk to consist of such a material. However, by means of the detachable connection described, the element made of ceramic can be combined in a simple manner with, for example, a centrifugal disk produced from a metal.

BRIEF DESCRIPTION OF THE DRAWINGS

Further details of the invention evident from the following description of preferred embodiments shown schematically in the drawings

DETAILED DESCRIPTION OF THE PREFERRED EMBODIMENTS

Figure 1:
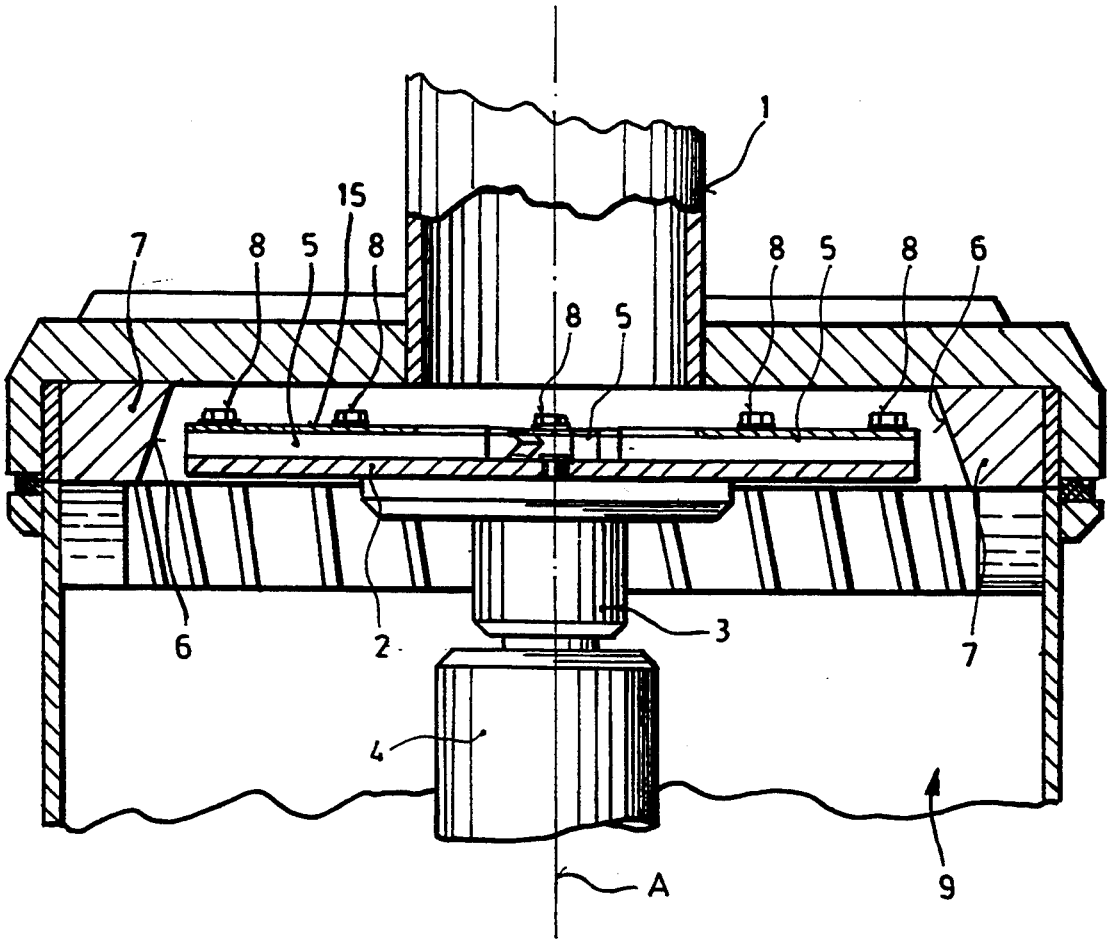
FIG. 1 shows a longitudinal section through an impact mill equipped with a centrifugal disk according to the invention.

FIG. 1 shows an impact mill whose general structure is known from the U.S. Patent already mentioned. It has an inlet tube 1, via which the granular material or the like to be processed is allowed to fall onto a centrifugal disk 2. This centrifugal disk 2 is mounted in a bearing element 3 supported by spokes (not shown) and is driven by means of an electric motor 4 fixed to the bearing element 3. The centrifugal disk 2 is surrounded by an impact ring 7, for example having an oblique impact surface 6, radially outside the centrifugal disk 2.

Figure 2:
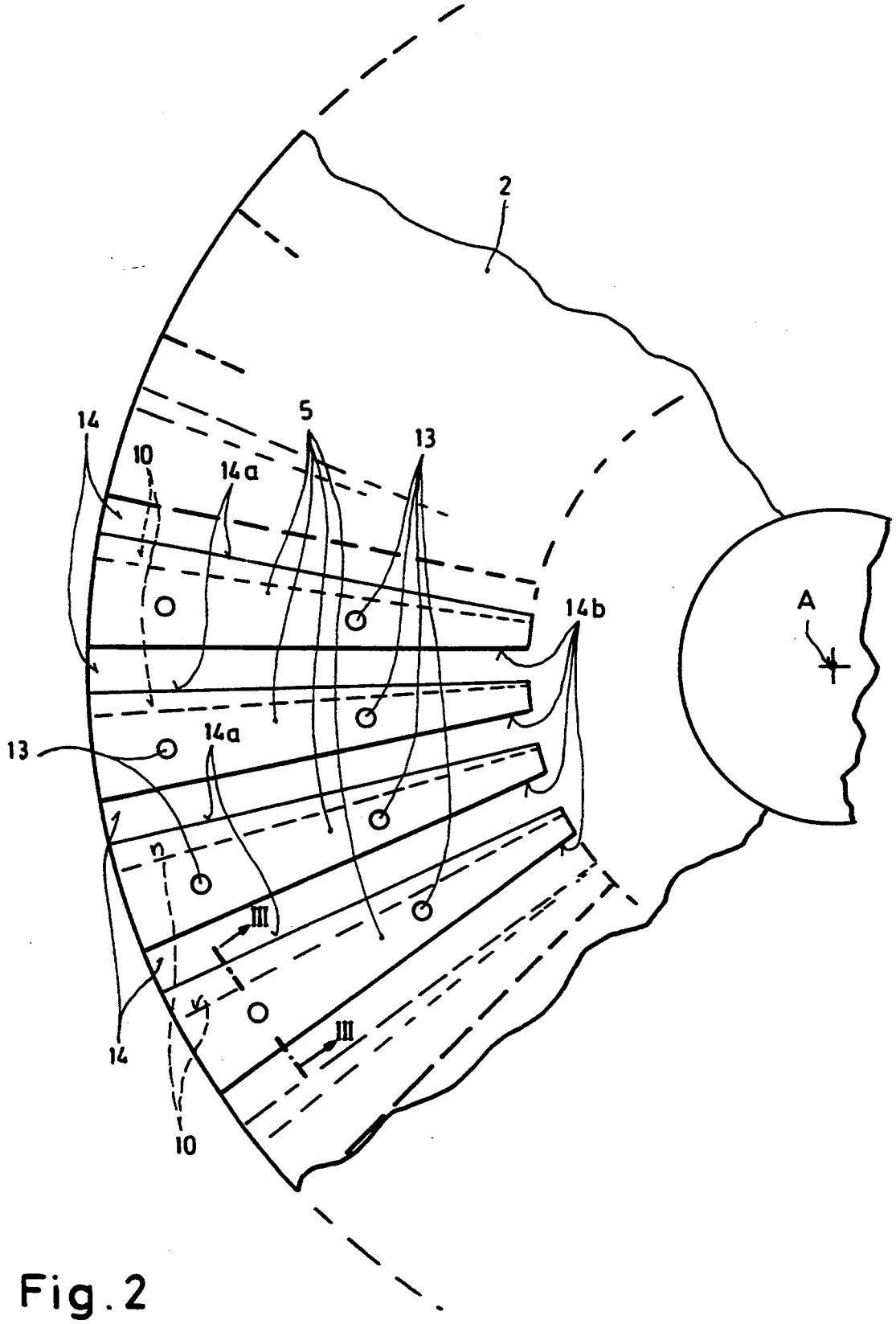
FIG. 2 shows a plan view of a centrifugal disk according to the invention, represented in part.

As is also evident from FIG. 2, in contrast to the known design, sector-like elements 5 which form radial channels 14 and widen towards the outside so that they form approximately parallel channel-bounding end walls 14*a*, 14*b* are provided on the upper surface of the centrifugal disk 2. As can be seen, these sector-like elements 5 are provided with holes 13 and are fixed with the aid of bolts 8 according to FIG. 1 to the centrifugal disk 2 so that, on the one hand, they can be easily replaced but, on the other hand, they can also be produced from a material differing from the material of the centrifugal disk 2, in particular a harder material, such as hard metal, but preferably from ceramic.

As can furthermore be seen from FIG. 1, the ribs or sector elements 5 extend to a point relatively close to the axis of rotation A of the centrifugal disk and expediently at least as far as the opening area of the inlet tube 1, projected onto the centrifugal disk 2, so that granular material falling down is immediately picked up by the ribs 5 and is subjected to the influence of the centrifugal force immediately after entering the milling space enclosed by a mill housing 9.

Figure 3:
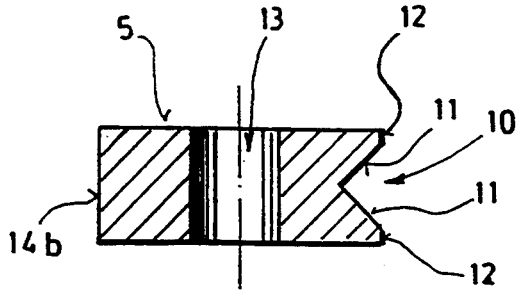
FIG. 3 shows a section along the line III—III in FIG. 2.

FIG. 3 shows the cross-section of the sector elements 5. The essential feature here is that it has a triangular notch 10 which borders the radial channel 14 and is bordered by notch surfaces 11. This notch does not have a constant cross-section at any point but diverges increasingly—viewed toward the front in the direction of rotation of the centrifugal disk 2—so that grains of any size are trapped therein and brought to their optimal trajectory toward the impact surfaces 6 without being able to remain in the channel formed by the notch 10—regardless of their size. Since the notches 10 each face forward in the direction of rotation, a direction of rotation in the clockwise direction occurs in the case of FIG. 2, in which the triangular notches 10 are each indicated by a radial dashed line. If it is desired to drive the turntable 2 alternatively in opposite directions of rotation, each sector element 5 could have such a notch 10 on each of its end surfaces 14*a* and 14*b*.

When the sector elements are formed from a hard metal, the surfaces 11 could theoretically also end in the corners of the sector element 5 having a rectangular cross-section. However, this would lead to the formation of edges which might damage the material, as occurred in the prior art. It is therefore preferable if a part of the end wall 12 bordering the sector element 5 having a rectangular cross-section remains blunt. However, the result of this is that it is now also possible to use materials for the sector element 5 which would not be expediently producible with sharp edges, namely ceramic, such as aluminum oxide ($Al_2O_3$), but possibly also silicon nitride or silicon carbide. This is compensated by the fact that, owing to the triangular notch 10, the grains scarcely scrape against the surface of the centrifugal disk 2 itself and the latter can therefore be produced from a less brittle and abrasion-resistant material, such as certain cast iron grades. Fixing of the ribs or sector elements 5 to the centrifugal disk 2 may be effected in principle in any manner, but a detachable connection, such as by means of the bolts 8, is preferred. FIG. 1 shows that, relative to the opening surface of the inlet tube 1, projected onto the centrifugal disk 2, the bolts are arranged relatively far outside said surface, so that they are not contaminated by the grains entering the milling space and on the other hand cannot damage said grains.

In this context, it should be pointed out that, for several reasons, it is advantageous for a cover 15 having a central orifice located below the inlet tube 1 (FIG. 1) to be arranged with the aid of the bolts 8 above the sector elements 5. On the other hand, such a cover produces a distribution of the forces of bolts 8 over a larger area in order in this way to protect the pressure-sensitive ceramic parts 5. The embodiment may even be such that the cover 15 is slightly spring-loaded under pressure of the bolts 8. However, the cover 15 also has the function of preventing individual particles from spraying upward on impact with the disk 2.

When it was stated above that the sector elements 5 has a rectangular cross-section, this means that this applies only to the general contour, since, when ceramic is used, it will be expedient if all edges are rounded off, beveled or otherwise blunted in a suitable manner.

EXAMPLE

An impact mill having a centrifugal disk 2 of the type shown in FIG. 1 was used for dehusking oats. In addition to this impact mill, an impact mill provided with a centrifugal disk having conventional channels without the triangular notches 10 shown in FIG. 3 was loaded with the same husk material. Finally, the dehusking results were investigated. In both cases, approximately the same degree of dehusking was observed, but the mill equipped according to the invention was found to contain only about half the amount of fragments compared with that found in the conventional mill, which was evidently due to the much more optimal trajectories of the grains in the mill equipped according to the invention.

What is claimed is:

1. A rotor disc for accelerating and projecting particles radially outwards from said disc, said disc comprising:

rib means fixed to said disc base and being arranged serially around said disc, said rib means being spaced apart to define radial channels for guiding said particles radially outwards;

wherein said rib means have side wall means with pairs of corresponding first and second side faces located on opposite sides of respective ones of said channels;

corresponding side faces of each of said pairs are arranged essentially parallel; and at least said first side face of each of said rib means has a radial chamfer with a first and a second chamfer face which are inclined relative to each other to define a radially extending notch, said first side face including an end wall disposed between an adjacent one of said chamfer faces and said disc base to introduce a spacing between said notch and said disc base.

2. Rotor disc as claimed in claim 1 wherein said chamfer has a width which diverges radially outwards.

3. Rotor disc as claimed in claim 2 wherein a diverging of the chamfer width along the chamfer is constant.

4. Rotor disc as claimed in claim 1 wherein a cross section of one of said rib means at its chamfer has the shape of a triangle.

5. Rotor disc as claimed in claim 1 further comprising chamfer edges inside said chamfer and at the sides of said chamfer wherein, in one of said rib means, a chamfer face meets an adjoining surface at an obtuse angle.

6. Rotor disc as claimed in claim 1 further comprising chamfer edges inside said chamfer and at the sides of said chamfer wherein said edges define an interface between two chamfer faces disposed at an obtuse angle.

7. Rotor disc as claimed in claim 1 wherein said side wall means of an individual one of said rib means provide a circular sector shape to the rib means.

8. Rotor disc as claimed in claim 1 wherein each of said side wall means is elongated in radial direction of said disc.

9. Rotor disc as claimed in claim 1 wherein said rib means are detachably fixed to said disc base.

10. Rotor disc as claimed in claim 1 wherein said rib means are fixed to said rotor base by at least one screw joint.

11. Rotor disc as claimed in claim 1 wherein said rib means are fixed to said rotor base by at least one rivet joint.

12. Rotor disc as claimed in claim 1 wherein one of said rib means is fastened to said rotor base by plural screw joints.

13. Rotor disc as claimed in claim 1 wherein said rib means is glued to said rotor base.

14. Rotor disc as claimed in claim 1 wherein said rib means are made of a ceramic material.

15. Rotor disc as claimed in claim 14 wherein said ceramic material is resistant to mechanical wear.

16. Rotor disc as claimed in claim 14 wherein said ceramic material is aluminiium oxide.

17. Rotor disc as claimed in claim 14 wherein said ceramic material is silicon nitride.

18. Rotor disc as claimed in claim 14 wherein said ceramic material is silicon carbide.

19. Rotor disc as claimed in claim 1 further comprising disc top means arranged on top of said wall means, and having a central opening giving free passage to said particles to reach said disc base.

20. Rotor disc as claimed in claim 19 further comprising fixing means for connecting said top means to said wall means.

21. An impact mill for milling particles comprising a rotatable rotor disc for receiving said particles in a central area and accelerating said particles radially outwards, said rotor disc including a rotatable disc base;

rib means fixed to said disc base and being arranged serially around said disc, said rib means being spaced apart to define radial channels for guiding said particles radially outwards;

wherein said rib means have side wall means with pairs of corresponding first and second side faces located on opposite sides of respective ones of said channels;

corresponding side faces of each of said pair are arranged essentially parallel; and at least said first side face of each of said rib means has a radial chamfer with at least a first and a second chamfer face which are inclined relative to each other to define a radially extending notch, said first side face including an end wall disposed between an adjacent one of said chamfer faces and said disc base to introduce a spacing between said notch and said disc base;

said mill further comprises feeding means for feeding said particles to said central area wherein said feeding means have inlet means arranged adjacent to said area; and turning means for holding and turning said rotor disc, and impact means for receiving said accelerated particles, said impact means extending at least partially around said rotor disc.

* * * * *